United States Patent [19]

Hamsher, Jr. et al.

[11] 4,303,294

[45] Dec. 1, 1981

[54] COMPOUND SPRING CONTACT

[75] Inventors: Wilbur A. Hamsher, Jr., Carlisle; Robert N. Weber, Hummelstown, both of Pa.

[73] Assignee: AMP Incorporated, Harrisburg, Pa.

[21] Appl. No.: 130,759

[22] Filed: Mar. 17, 1980

[51] Int. Cl.[3] ..... H01R 13/62

[52] U.S. Cl. ..... 339/74 R

[58] Field of Search ..... 339/74 R, 75 MP, 176 MP

[56] References Cited

U.S. PATENT DOCUMENTS 3,899,234 12/1975 Yeager et al. ..... 339/74 R
4,047,782 9/1977 Yeager ..... 339/75 MP
4,179,177 12/1979 Lapraik ..... 339/74 R
4,226,496 10/1980 Langham ..... 339/176 MP

OTHER PUBLICATIONS

IBM vol. 13, No. 9, 2-1971, p. 2612.

*Primary Examiner*—Joseph H. McGlynn
*Attorney, Agent, or Firm*—Russell J. Egan

[57] ABSTRACT

An improved contact is disclosed for use in zero insertion force connectors. The subject contact is a compound spring formed from a single piece of metal stock, a portion of which is skived to achieve dual thickness stock. The contact is formed as a compound beam such that the loading thereof provides differential deflection of the contact so that a wiping action is performed at a point of engagement with a circuit board.

9 Claims, 5 Drawing Figures

COMPOUND SPRING CONTACT

BACKGROUND OF THE INVENTION

1. The Field of the Invention

The present invention relates to electrical contacts and in particular to a double beam contact for use in cam actuated zero insertion force connectors.

2. The Prior Art

Zero or low insertion force electrical connectors are well known, as represented by U.S. Pat. Nos. 3,899,234 and 4,047,782. Each of the known rotary cam actuated low insertion force connectors is somewhat similar in that it comprises a housing having an elongated board receiving opening with a channel at the base of the opening. A rotary cam is positioned in the channel and acts on a cam follower which directly engages contacts located in parallel spaced alignment along both sides of the elongated opening. Rotation of the cam moves the cam follower to drive the contacts normally with respect to the elongated opening so that, in an actuated condition, they will be free of the opening allowing no force insertion of the circuit board and, upon further movement of the cam, the contacts are allowed to drop by their own spring action against the opposite surfaces of the circuit board to make engagement therewith.

While such connectors as described above functioned quite well, the contacts are not able to penetrate any contaminant films that might build up on the contact interface and in particular on the pads of the circuit boards. It is highly desirable that the contacts have a wiping action to displace or break through these films to provide a better contact. However, a feature of the zero insertion force connectors is that there is no wiping action of the contacts against the pads during insertion of a circuit board or engagement therewith.

SUMMARY OF THE INVENTION

The subject compound spring contact is particularly suitable for use in zero insertion force edge board connectors to provide a wiping action of the contact upon engagement with a circuit board. The subject contact is formed from a single piece of metal stock, a portion of which is of a reduced thickness to give a compound spring effect to the contact. The subject contact includes an end spring section having an action surface and a contact surface, a beam section of greater thickness than said end section and having a protrusion and a spaced staking bump, a mounting section having a shoulder, and a terminal pin section.

It is therefore an object of the present invention to produce a contact for zero insertion force connectors which contact has a compound spring action to provide contact wipe against the surface of a circuit board.

It is another object of the present invention to produce an improved electrical contact having a compound spring effect to provide a wiping action.

It is a further object of the present invention to produce an improved electrical contact having two areas of different thicknesses thereby providing a compound spring action.

It is a still further object of the present invention to produce an improved electrical contact which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
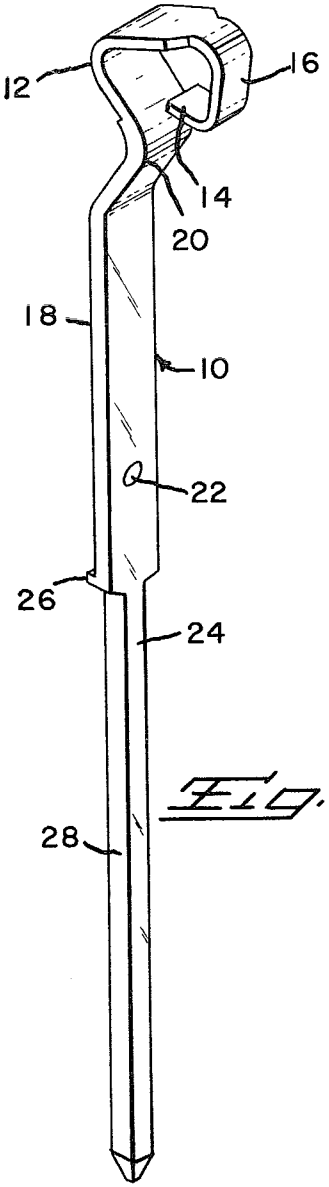
FIG. 1 is a perspective view of an electrical contact according to the present invention.

A contact 10 according to the present invention is shown in FIG. 1 and would be formed from premilled dual thickness stock to provide two primary moment centers, namely a thin end spring section 12 having an action surface 14 and a contact surface 16 and an intermediate thicker spring section 18 having a protrusion 20 and staking bump 22. The contact also includes a mounting portion 24 having mounting shoulder 26 and a terminal pin portion 28. The end section is shown profiled to define eleven beam segments while the intermediate section is profiled to define five beam segments. Preferably there should be at least twice as many beam segments in the end section as the intermediate section.

A representative zero insertion force connector 30 is shown in FIGS. 2–5 and includes a housing 32 having an elongated opening 34 with a channel 36 opening into the base of the opening 34. A rotary cam 38 is positioned in the channel 36 to act against a channel shaped cam follower 40 having spaced sidewalls 42, 44. The upper edges 46, 48 of the cam follower sidewalls engage the action surfaces 14 of a dual row of terminals 10 mounted along both sides of the opening 34 and staked in place by plastic deformation of the housing 32.

The subject contact can be broken down into sixteen beam segments of rotation of which eleven are in the end portion 12 and the remainder in the intermediate section. Thus the end spring section is considerably longer than the known prior art.

Figure 3:
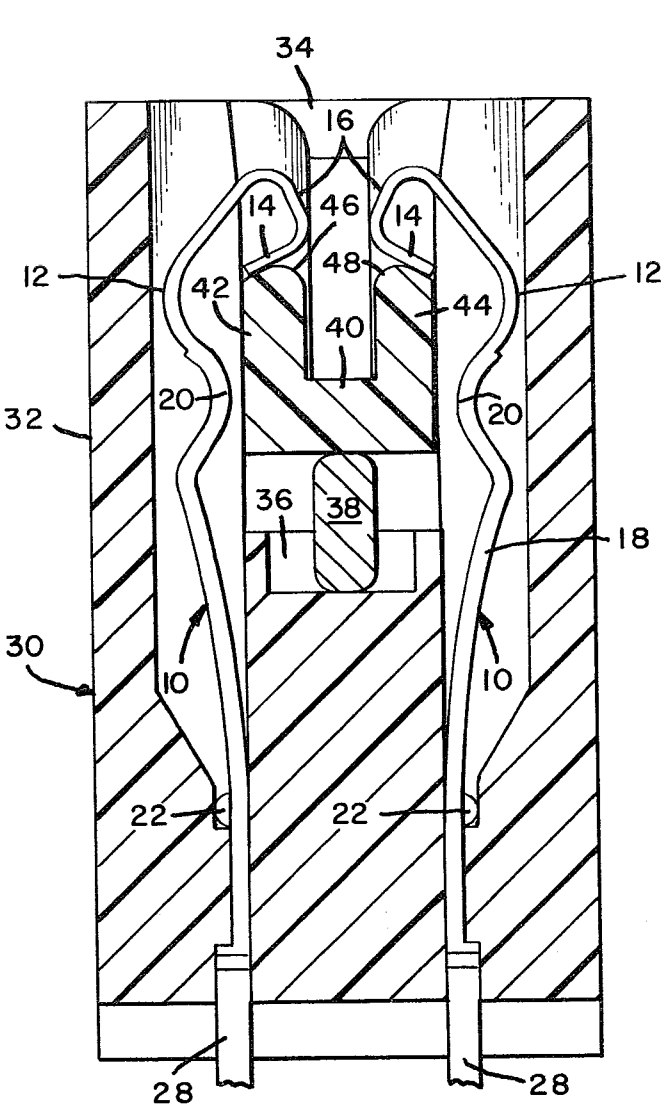
FIG. 3 is a view similar to FIG. 2 showing the connector actuated to open the contacts to receive a circuit board therebetween.

The cam follower applies a force to the action surface of the end spring section of the contacts to move the contact surface which would be parallel to the face of the circuit board 50 and the pads 52, 54 carried thereby. Upon opening of the contacts of the connector, as shown in FIG. 3, the upper end spring section 12 opens considerably before movement occurs about the staking bump 22 by the second spring section 18 because the camming force is applied parallel to the second spring section 18 until the end spring section 12 is deflected enough to change the direction and point of application of that camming force. The contacts are preloaded with the protrusions 20 lying against the cam follower sidewalls 42, 44 to reduce the deflection required to generate a minimum normal force against a minimum thickness circuit board and to increase the normal force values to compensate for spring set.

Figure 2:
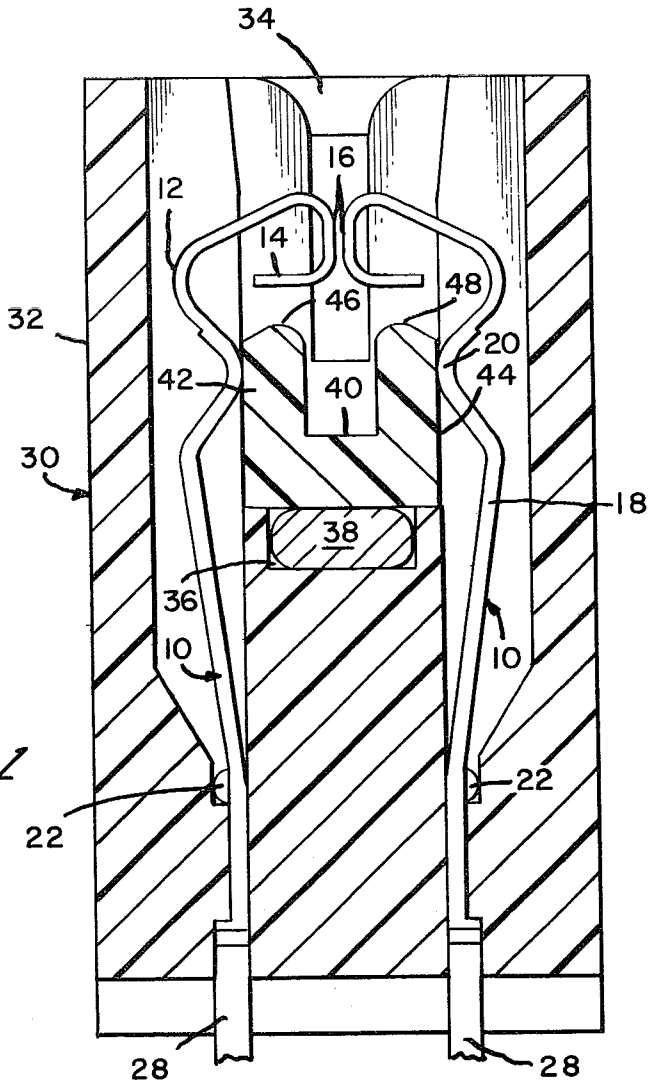
FIG. 2 is a transverse section through a zero insertion force connector embodying contacts according to the present invention, said connector being shown with the contacts in a preloaded condition.
Figure 4:
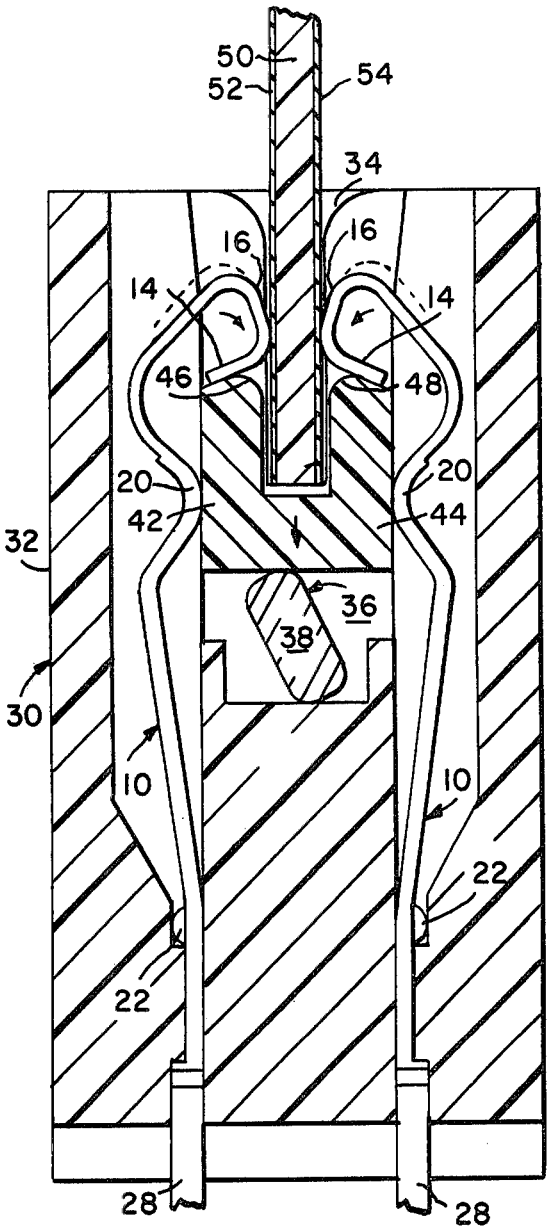
FIG. 4 is a view similar to FIGS. 2 and 3 showing the initial engagement of the contacts with the pads of the circuit board.
Figure 5:
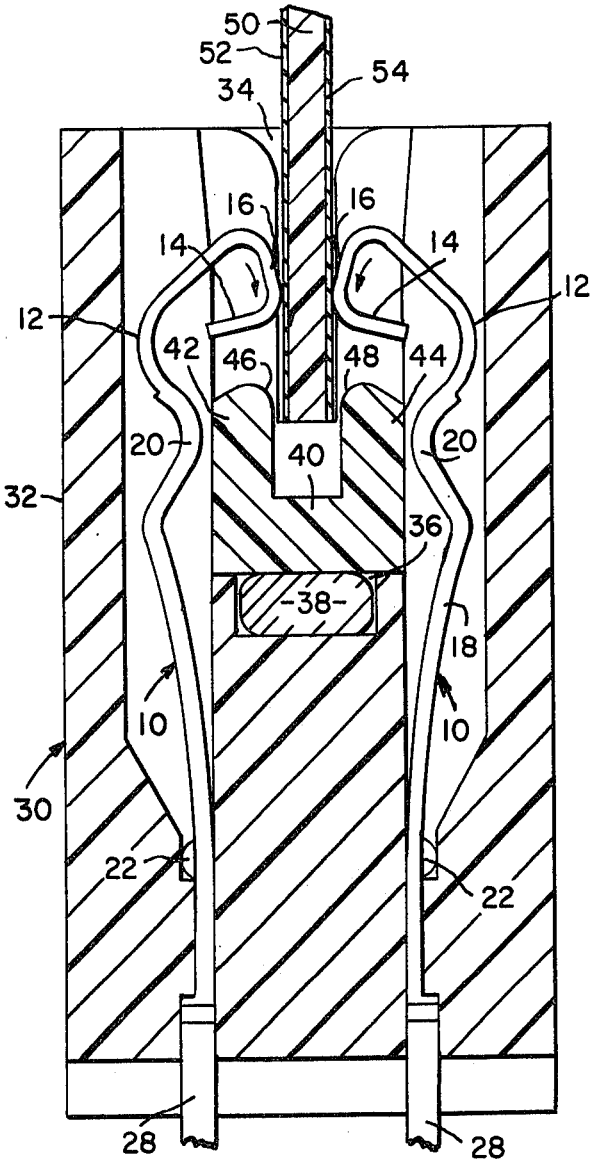
FIG. 5 is a view similar to FIGS. 2–4 showing the wiping action of the subject contacts.

After a circuit board 50 has been inserted into the opening 34, the cam 38 is rotated to allow return of the cam follower 40 to the position shown in FIG. 2. The contacts 10 are released and make initial contact with the pads 52, 54 of the circuit board 50, as shown in FIG. 4. Continued withdrawal of the cam follower causes a wiping action as seen by a comparison of FIGS. 4 and 5 with FIG. 5 showing the contacts in their rest condition against the pads 52, 54 of the circuit board 50. It will be noted here that the intermediate spring sections 18 have been deflected. With a board in place, the rotation of end section 12 becomes translated into linear motion parallel to the face of the board.

The present invention may be subject to many changes and modifications without departing from the spirit or essential characteristics thereof. The present embodiment is therefore to be considered in all respects as illustrative and not restrictive of the scope of the invention.

What is claimed is:

1. An electrical terminal for a zero insertion force connector, the terminal which is in the form of a strip of resilient sheet metal stock, comprising a contact spring portion at one end, a mounting part at the opposite end, and a spring beam part intermediate the contact spring portion and the mounting part, the contact spring portion having a contact surface and an abutment surface to which a force can be applied lengthwise of the terminal resiliently to deflect the spring beam part and the contact spring portion relative to the mounting part, when the mounting part is fixedly positioned in a support; the contact spring portion being so formed that upon the initial application of the force to the abutment surface, in the lengthwise direction of the terminal, the contact spring portion is deflected relative to the spring beam part prior to the spring beam part being deflected relative to the mounting part, whereby upon cessation of the force, the contact spring portion returns towards its initial position along such a return path that the contact surface wipes along an electrical conductor when such is positioned so as to intersect the return path of the contact surface.

2. A terminal according to claim 1, in which the contact spring portion is in the form of a hook having an inwardly directed free end portion the outer face of which constitutes the abutment surface, the contact surface which is constituted by an outer face of the hook adjacent to the abutment surface, being substantially parallel to the spring beam part and the contact surface being substantially at right angles to the abutment surface.

3. A terminal according to claim 1, in which the contact spring portion is shaped so as to consist of a multiplicity of beams having axes of rotation spaced peripherally of the contact spring portion.

4. A terminal according to claim 3, in which the axes of rotation of the contact portion are eleven in number, the spring beam part having five such centers of rotation.

5. A terminal according to claim 1, 2, or 3, in which the metal stock has been pre-milled so that the contact spring portion is of reduced thickness.

6. A terminal according to claim 1, 2, or 3, in which the spring beam part has a bowed part adjacent to the contact spring portion, the crest of the bowed part being directed in the return direction of the spring beam part.

7. A zero insertion force circuit board edge electrical connector, comprising an insulating housing having an elongate opening for receiving a circuit board along a board insertion path; at least one row of electrical terminals positioned beside the opening and extending in the longitudinal direction thereof, each terminal having at one end a resilient contact spring portion having an abutment surface and a contact surface for engaging a conductor of the circuit board when such has been inserted into the opening along the insertion path, a mounting part fixedly positioned in the housing and a spring beam part intermediate the contact spring portion and the mounting part; and a cam follower being displaceable by a cam between a first position in which a cam surface of the cam follower engages the abutment surfaces of the terminals to deflect the contact spring portions and the spring beam parts of the terminals away from the insertion path and a second position in which the cam follower is retracted to allow the contact spring portions to intersect the insertion path; each contact spring portion being so formed that when its abutment surface is engaged by the cam surface of the cam follower, the contact spring portion is deflected away from the board insertion path, in relation to the spring beam part, prior to the spring beam part being deflected away from such path, the contact spring portion returning under its own resilience, upon retraction of the cam follower, along such a path that the contact surface of the contact spring portion, after initially engaging the conductor of the inserted circuit board, wipes along the surface of such conductor.

8. A connector according to claim 7, in which the abutment surface of each contact spring portion extends substantially at right angles to the board insertion path and substantially at right angles to the mounting part, in the second position of the cam follower, the cam follower initially applying a force to the abutment surface, normally thereof, whereafter the line of action of the force is inclined in a direction away from the board insertion path.

9. A connector according to claim 7 or 8, in which the spring beam part of each terminal is provided with a projection which resiliently engages the cam follower in the second position thereof so as to pre-load the terminal.

* * * * *